United States Patent [19]

Conn et al.

[11] 4,135,660

[45] Jan. 23, 1979

[54] ADJUSTABLE TUBE RACK CARRIER

[75] Inventors: Thomas E. Conn, Palo Alto; Victor J. Grilli, Mountain View, both of Calif.

[73] Assignee: Beckman Instruments, Inc., Fullerton, Calif.

[21] Appl. No.: 808,201

[22] Filed: Jun. 20, 1977

[51] Int. Cl.[2] ..... B04B 5/04

[52] U.S. Cl. ..... 233/26; 211/184

[58] Field of Search ..... 233/26, 27, 1 R; 211/184, 74

[56] References Cited

U.S. PATENT DOCUMENTS

| | | | |
|---|---|---|---|
| 386,674 | 7/1888 | Wells | 211/184 X |
| 2,953,258 | 9/1960 | Streit | 211/184 |
| 3,674,198 | 7/1972 | Eberle | 233/26 |
| 3,786,933 | 1/1974 | Vianzon | 211/184 X |
| 3,873,021 | 3/1975 | Paulsen | 233/26 |

*Primary Examiner*—George H. Krizmanich

*Attorney, Agent, or Firm*—Robert J. Steinmeyer; F. L. Mehlhoff; W. H. May

[57] ABSTRACT

A pivotal carrier for use in centrifuge rotors wherein the ends of the rotor carriers are adjustable to vary the supporting or receiving surface area in the carrier to accommodate various sized tube racks which may be used in the centrifuge rotor. Holding members in opposite ends of each carrier are movable to a plurality of positions to symmetrically position the tube rack within the carrier to maintain dynamic rotor balance.

4 Claims, 4 Drawing Figures

ADJUSTABLE TUBE RACK CARRIER

BACKGROUND OF THE INVENTION

This invention is directed to pivotal carriers on centrifuge rotors and more particularly is directed to carriers having adjustable ends to vary the size of the receiving area in the carrier to accommodate various sized tube racks which may be inserted into the carrier.

Typically, in diagnostic investigation of a plurality of fluid samples, racks are used to carry and hold several test tubes. This is done not only for ease of movement of a plurality of test tubes as a single unit, but also for a transfer vehicle to carry the tubes through a diagnostic or analytic instrument. The size of the tube rack is normally dictated by its compatibility with the particular diagnostic instrument. For example, the sample fluids may be subjected to a radioimmunoassay test wherein the particular radioimmunoassay instrument is designed to accommodate a certain sized tube rack. For other types of analytical instruments different sized tube racks may be required, depending upon the design of the manufacturer. Therefore, the operator in a clinical laboratory is faced with the necessity to use various sized tube racks depending upon which of the numerous types of analytical instruments he is using.

During the analysis of the samples, it is necessary to subject the sample to centrifugation in order to separate the constituents in the fluid sample to provide the required isolation of certain constituents for proper analytical work on the sample. The operator in the clinical laboratory, therefore, is faced with the problem of having to place each test tube individually into the centrifuge for centrifugation run and individually remove each after the run for replacement in the necessary rack for use in a particular instrument. However, some centrifuges have carriers which are specifically designed to accommodate a certain sized rack. A different or modified carrier is needed for each different sized rack.

Since it is extremely important that the tube racks be positioned and held symmetrical to the supporting pivot axis of the carrier to maintain dynamic rotor balance, it is critical that the carriers on the rotor accurately accommodate the particular sized tube rack. Consequently, the manufacturer of the centrifuge must supply the centrifuge user with various carrier sizes to hold the different sized tube racks or various sized tray members for insertion in the carrier to hold various rack sizes.

This requires not only increased cost because of the additional sizes and parts necessary to accommodate these various sized racks, but also results in considerable time wasted to continually change trays and/or racks to accommodate the various rack sizes required for the different diagnostic/analytical equipment that is to receive the centrifugated samples.

SUMMARY OF THE INVENTION

The present invention comprises a pivotal carrier for a centrifuge rotor with means located in the carrier to adjust the length of the receiving area in the carrier for the tube racks, so that one sized carrier can receive various length racks for use in different centrifugation runs. In addition, this adjustment means within the carriers will orient the racks on the carrier in a precise position to be symmetrical to the supporting pivot axis of the carrier, so that dynamic rotor balance is maintained.

The present invention, therefore, provides the operator of the centrifuge the ability to adjust the size of the carrier quickly and efficiently prior to the insertion of a different sized tube racks and trays for centrifugation. The adjustment mechanism is designed for easy movement without the requirement for some type of auxiliary tool.

The present invention enables an operator in the clinical laboratory to use different types of analytical equipment, requiring different sized tube racks, compatibly with one centrifuge having an adjustable mechanism in its rack carrier.

DETAILED DESCRIPTION OF THE INVENTION

Figure 1:
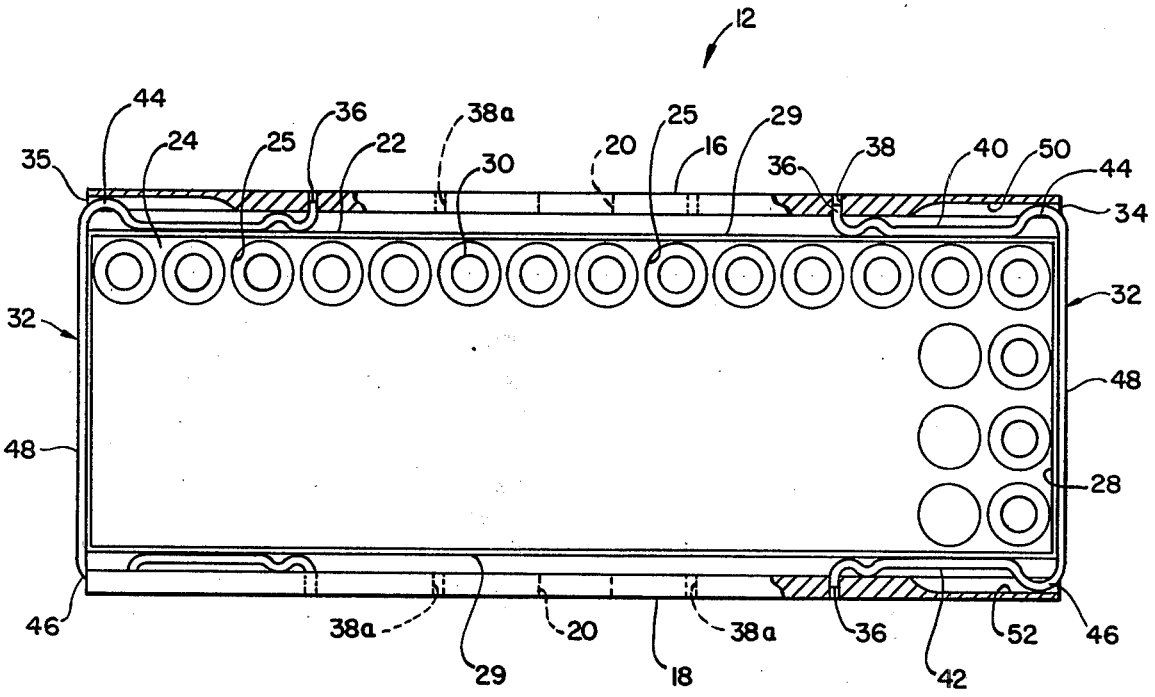
FIG. 1 is a plane view of the rotor carrier with its adjustable ends extended to its maximum dimension.
Figure 3:
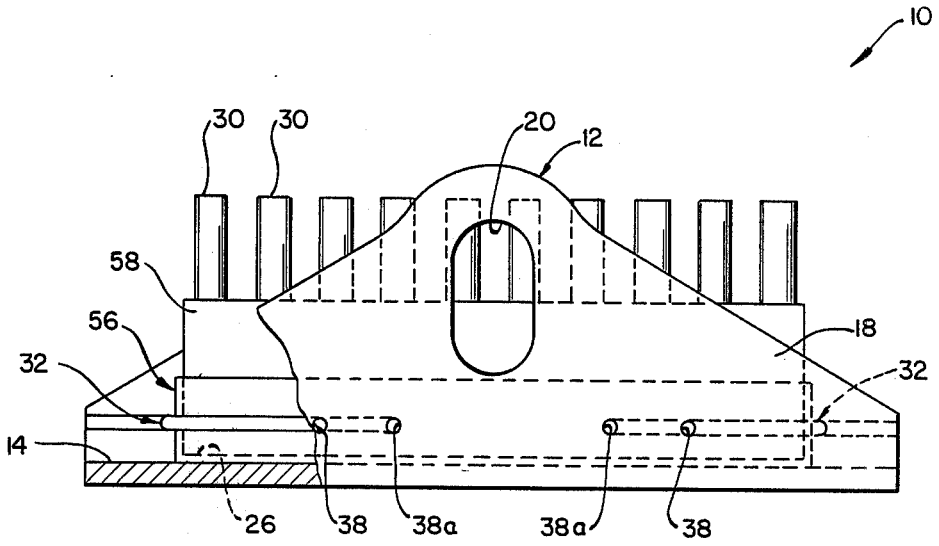
FIG. 3 is a side elevational view of the rotor carrier.
Figure 4:
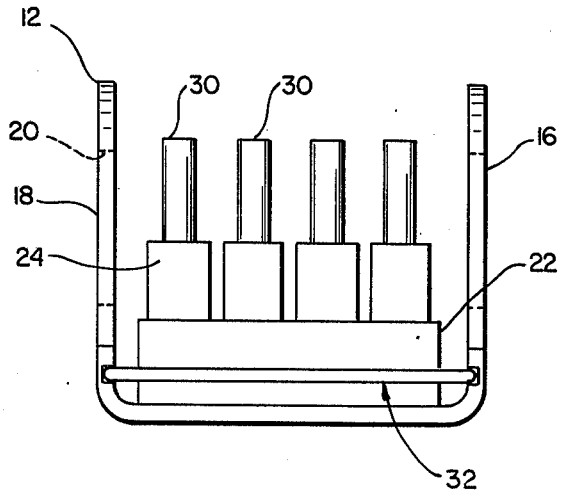
FIG. 4 is an end elevational view of the carrier.

The adjustable tube rack carrier 10 is shown in FIGS. 1 and 3. The carrier member 12 is comprised of a support surface 14 and two hanger sides 16 and 18. Through each of the hanger sides is located a carrier pivot hole 20 which receives pivot pins (not shown) that are located on the centrifuge rotor (not shown). Consequently, during operation of the centrifuge rotor the carrier 12 will pivot, so that the support surface 14 will assume a vertical or nearly vertical orientation during the centrifugation process.

Located within the carrier and situated on the support surface 14 is a tube rack tray 22 which is designed to receive a plurality of tube racks 24. The tray 22 is a rectangular shaped member having a support surface 26 with two upwardly extending end walls 28 and two side walls 29 for containing the tube racks 24. The length of the tray 22 is made to accommodate the particular length of the tube rack 24. The tray 22 is utilized to facilitate the movement of several tube racks together for placement into and out of the centrifuge.

The test tube racks 24 contain a plurality of cavities 25 for receipt of test tubes 30. The racks support these test tubes for secure movement to and from the centrifuge rotor carrier. The length and size of the test tube racks 24 depends upon the type of analytical instrument being used to receive fluid samples after centrifugation. Of the various analytical and diagnostic instruments found in a laboratory to analyze fluid samples each is designed to accommodate a different sized and configured tube rack for the movement of the rack through the automated sequence in the instrument.

The present invention incorporates the use of a holding member or clip 32 located at each of the ends 34 and 35 of the carrier 12. The clips 32 have a generally U-shaped configuration and are preferably made of a solid circular material. The clips should have a spring constant sufficiently low, so that the anchoring ends 36 which point outwardly can be moved into and out of adjustment holes 38 located along the lower portion of the sides 16 and 18 of the carrier 12. The clips 32 have curved protruding corners 44 and 46 adjacent the ends 48 of the holder to provide added strength to support the sides 40 and 42 of the clips. Also located within the holding sides 16 and 18 of the carrier at each end 34 and 35 are a pair of slots 50 and 52 which are designed to receive the protruding corners 44 and 46 of the clip and prevent the corners 44 and 46 from moving to the bottom or support surface 14 of the carrier during centrifugation.

In the operation of the present invention the clips 32 located at each of the ends 34 and 35 of the carrier can be adjusted to accommodate the length of the tube racks 24 to be placed in the centrifuge for centrifugation. As shown in FIG. 1, holding clips 32 are positioned so that their outer ends 48 are respectively adjacent the ends 34 and 35 of the carrier in order to accommodate the long tube racks 24. These holding clips 32 rigidly contain the tube racks and tray 22 symmetrically within the carrier, so that the rotor is in the proper dynamic balance during centrifugation.

Figure 2:
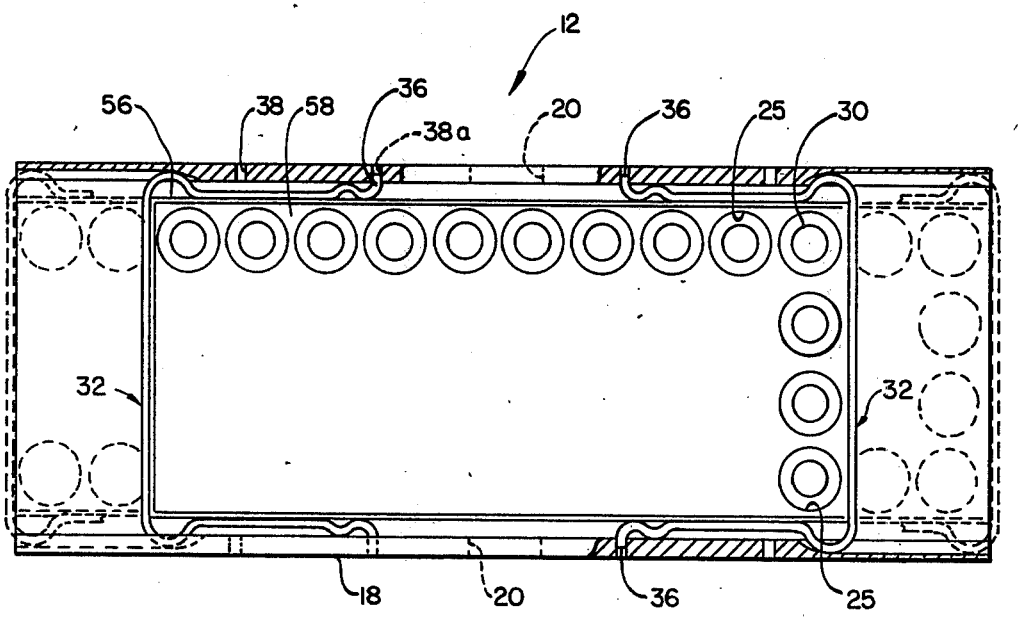
FIG. 2 is a plane view of the carrier with the adjustable ends moved to accommodate smaller tube racks than those shown in FIG. 1.

When smaller tube racks 58 such as shown in FIG. 2 are utilized, the holding clips 32 can be moved from the phantom position to their solid position to accommodate these smaller sized tube racks. In order to accomplish this, the legs 40 and 42 of the holder clips 32 are pushed toward each other before the racks are inserted to remove the ends 36 from within the first pair of holes 38. The clip can then be moved to a second pair of holes 38*a*. The outer end 48 of the clip is moved adjacent the ends of the smaller tube racks 58. If the racks are held in a tray 56, then the side 48 of the clip is adjacent the end of the tray. It should be noted that each of the holding clips 32 is moved inward to the second set of adjustment holes 38*a*, so that the racks 58 which are shorter than the racks 24 in FIG. 1 are symmetrically located on the carrier 12. Therefore, during centrifugation the loading will be balanced to provide the critical equilibrium of forces during centrifugation.

Although one embodiment of the clip is shown, alternate arrangements could be utilized to provide the same function and structure with respect to providing the ability to accommodate various sized tube racks to symmetrically hold them within the rotor carrier.

What is claimed is:

1. A centrifuge rotor for carrying test tube racks comprising:

at least two carriers, each pivotally mounted on said rotor; and a pair of removable U-shaped clips located in said carrier, said carrier having a series of adjustment holes to provide variable positions for said clips within said carriers for adjusting the length of the receiving area in said carriers for said racks to accommodate various length racks and hold said racks symmetrically positioned on said carriers.

2. A centrifuge rotor as defined in claim 1, wherein each of said pair of clips being positioned at opposite ends of said carrier and wherein each of said carriers has a support slot for each of said clips to retain the plane of said clips in an orientation generally parallel to said receiving area.

3. A centrifuge rotor for carrying test tube racks comprising:

at least two carriers pivotally attached to said rotor, each of said carriers having opposite open ends;

a pair of spring biased holding members, each adjustably positioned adjacent said opposite open ends of said carriers;

means within said carriers for retaining said holding members in a generally parallel orientation with the support base of each of said carriers; and means located in said carrier for receiving said holding members, said receiving means providing a plurality of selectible positions for said holding members, so that said carrier can accommodate various sized test tube racks.

4. A centrifuge rotor for carrying test tube racks comprising:

at least two carriers, each pivotally mounted on said rotor; and a pair of holding members selectively positioned at opposite ends of each of said carriers; and a series of adjustment apertures within each of said carriers for selective receipt of said holding members, said carriers accommodating and supporting various length tube racks in a secure symmetrical location on said carriers by selectively securing said holding members in one of said series of adjustment apertures.

* * * * *